US012275500B2

(12) United States Patent
Ludwick et al.

(10) Patent No.: US 12,275,500 B2
(45) Date of Patent: Apr. 15, 2025

(54) PONTOON BOAT

(71) Applicant: Bel-Aire Chassis Group, LLC, South Bend, IN (US)

(72) Inventors: Eric V. Ludwick, Niles, MI (US); Eric J. Johanson, Granger, IN (US)

(73) Assignee: Quantum Marine Incorporated, Wakarusa, IN (US)

( * ) Notice: Subject to any disclaimer, the term of this patent is extended or adjusted under 35 U.S.C. 154(b) by 542 days.

(21) Appl. No.: 17/653,050

(22) Filed: Mar. 1, 2022

(65) Prior Publication Data

US 2022/0281566 A1 Sep. 8, 2022

Related U.S. Application Data

(60) Provisional application No. 63/157,096, filed on Mar. 5, 2021.

(51) Int. Cl.
*B63B 35/38* (2006.01)

(52) U.S. Cl.
CPC ..... *B63B 35/38* (2013.01)

(58) Field of Classification Search
CPC ..... B63B 35/38; B63B 1/14; B63B 1/125
See application file for complete search history.

(56) References Cited

U.S. PATENT DOCUMENTS 2,786,284 A * 3/1957 Todd ..... E02F 3/06 37/350
5,117,774 A * 6/1992 English ..... B63C 11/49 114/66
2016/0311501 A1* 10/2016 Wang ..... B63B 43/06

* cited by examiner

*Primary Examiner* — Stephen P Avila
(74) *Attorney, Agent, or Firm* — Botkin & Hall, LLP; Michael D. Marston

(57) ABSTRACT

A pontoon boat having central pontoon located between outer pontoons. The outer pontoons are fixed with respect to the deck and the central pontoon is movably fixed with respect to the deck. The central pontoon is movable with respect to the outer pontoons and the deck between a first position that locates the central pontoon near the deck and a second position that locates the central pontoon relatively far from the deck. The central pontoon is selectively fixable between the first and second positions.

14 Claims, 15 Drawing Sheets

PONTOON BOAT

CROSS-REFERENCE TO RELATED APPLICATIONS

This application claims the benefit of the Provisional U.S. Patent Ser. No. 63/157,096, filed Mar. 5, 2021, which is incorporated herein by reference in its entirety.

BACKGROUND OF THE INVENTION

Pontoon boats are extremely useful watercraft and are extremely popular for that reason. Pontoon boats have a large flat deck surface that is comfortable to move upon. The flat deck accommodates furniture that may be placed upon it and maximizes available room for the passengers. The deck is supported by a plurality of pontoons that displace water to support the boat. That displacement of water occurs whether the pontoon boat is moving or not.

Other boats such as V-hull boats have distinct advantages over traditional pontoon boats. V-hull boats support the weight of the boat not only by displacement but also by hydrodynamic forces that occur as the boat moves through the water. These types of boats have planning hulls. Boats with planning hulls work well for higher speeds and can provide more maneuverability. This is particularly useful for pulling water skiers. Generally, the handling characteristics of a V-hull boat are superior at high speed than a pontoon boat having flat fixed pontoons supporting the deck.

Attempts have been made to provide a pontoon boat that has good high speed handling characteristics. For instance, U.S. Pat. Nos. 7,950,340 and 8,186,291 attempt to provide a pontoon boat that has some features of a V-hull and a pontoon boat. In the case of these patents, the hull has a center pontoon that is lower than two outer pontoons that straddle the center pontoon. All three of the pontoons on the boats depicted in these patents are fixed with respect to the deck. When the pontoons are all fixed with respect to the deck, an engineering tradeoff must necessarily be made that will not provide suitable handling at all speeds. At low speeds, a pontoon boat with a fixed lower center pontoon may be inherently unstable. That is because having a pontoon that is low enough to be effective at high speed may not be well suited to slow operation. On the other hand, choosing good stability at low speeds with a fixed pontoon arrangement ensures that the hull will not be optimized for high-speed operation. There remains an unmet need to have a pontoon boat that is optimized for handling throughout its entire speed range.

SUMMARY OF THE INVENTION

The present invention is a pontoon boat having central pontoon located between outer pontoons. The outer pontoons are fixed with respect to the deck and the central pontoon is movably fixed with respect to the deck. The central pontoon is movable with respect to the outer pontoons and the deck between a first position that locates the central pontoon near the deck and a second position locating the central pontoon relatively far from the deck. The central pontoon is selectively fixable between the first and second positions.

Another aspect of the invention is that the central pontoon has a pitch in its first position and as the pontoon moves from its first position to its second position, the pitch of the pontoon with respect to the deck remains constant throughout its movement.

DETAILED DESCRIPTION OF THE INVENTION

Figure 5:
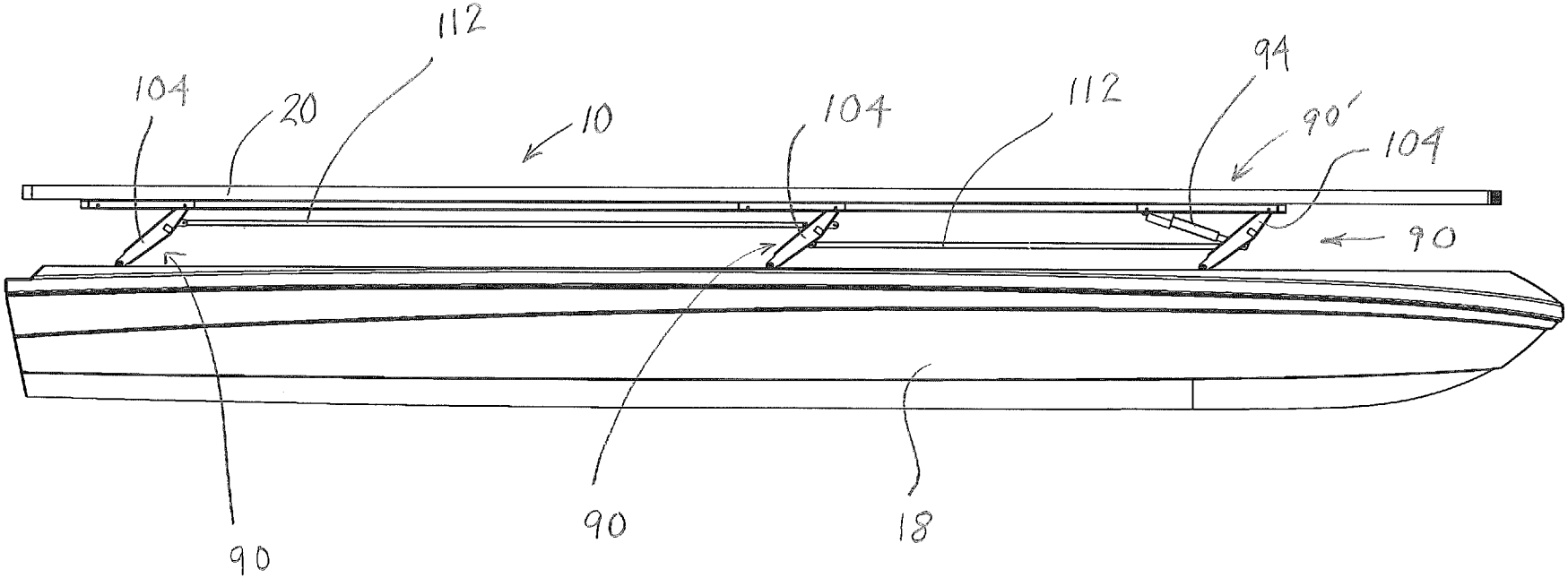
FIG. 5 is a sectional side view of the boat shown in FIGS. 1-4 with the central pontoon in its second position.
Figure 6:
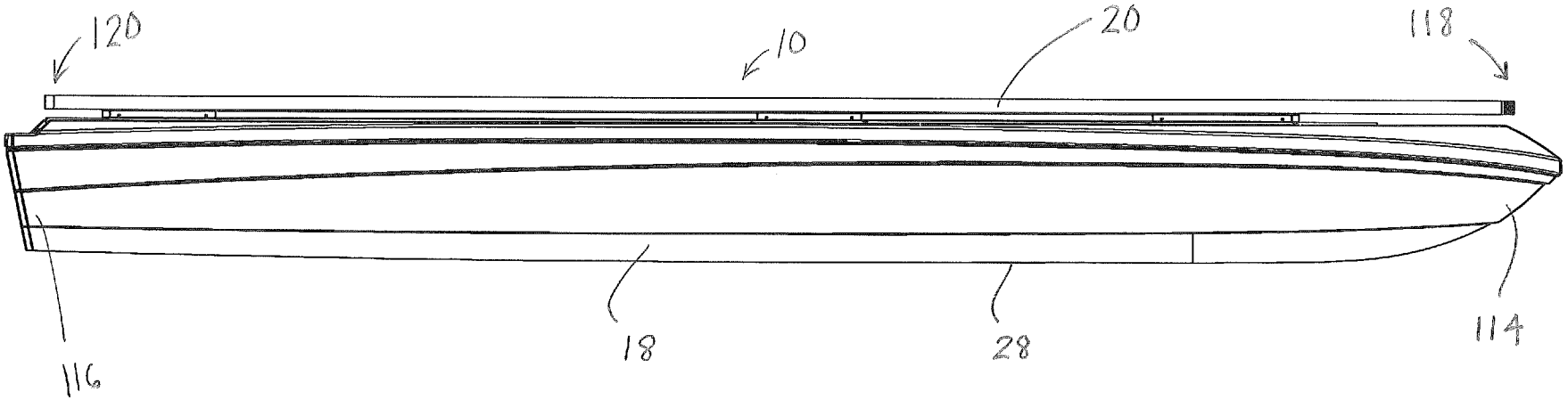
FIG. 6 is a sectional view of the boat shown in FIGS. 1-5 with the central pontoon in its first position.
Figure 7:
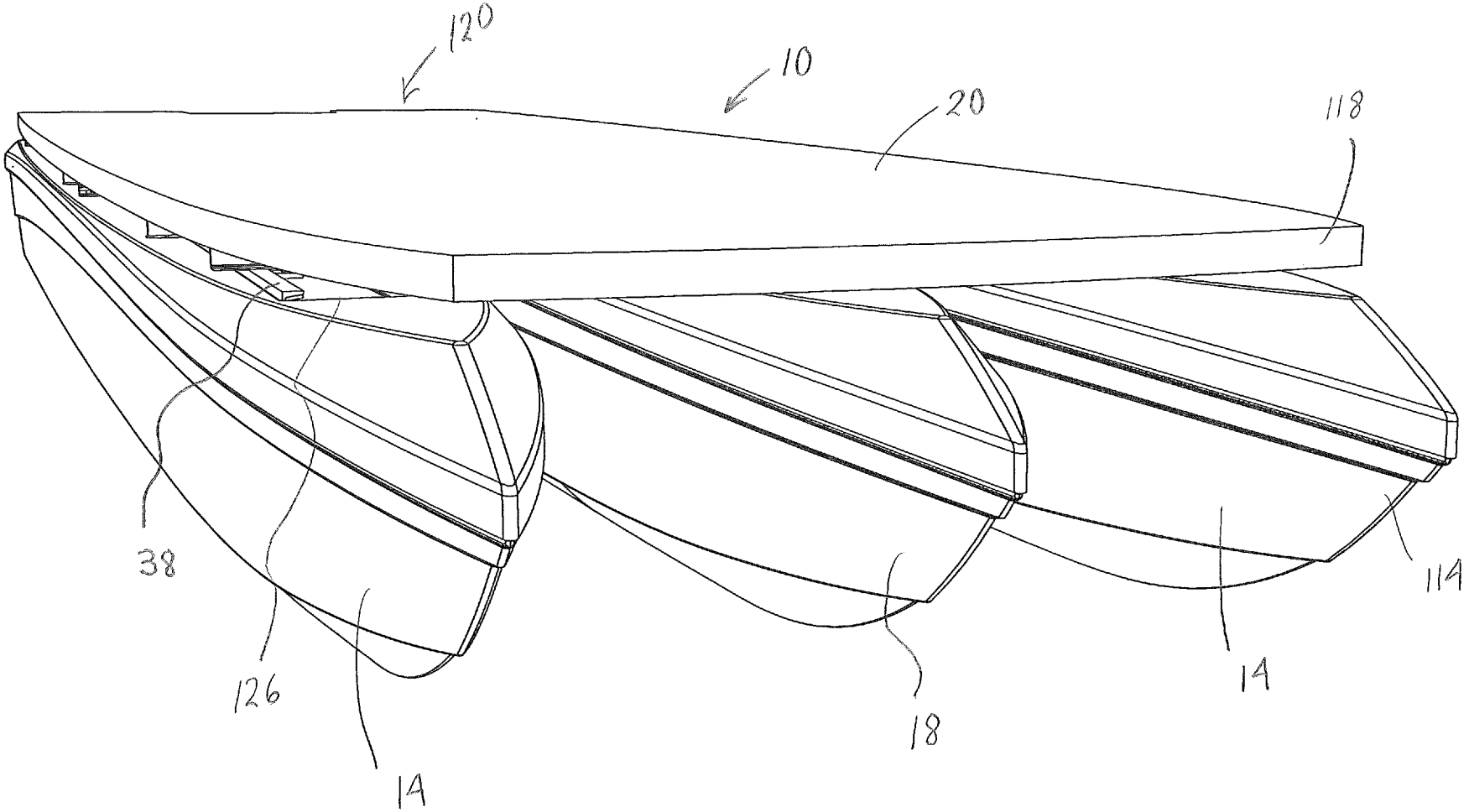
FIG. 7 is an isometric view of the boat in FIGS. 1-6 with the center pontoon in its first position and the lifting mechanisms in their fully retracted position.
Figure 8:
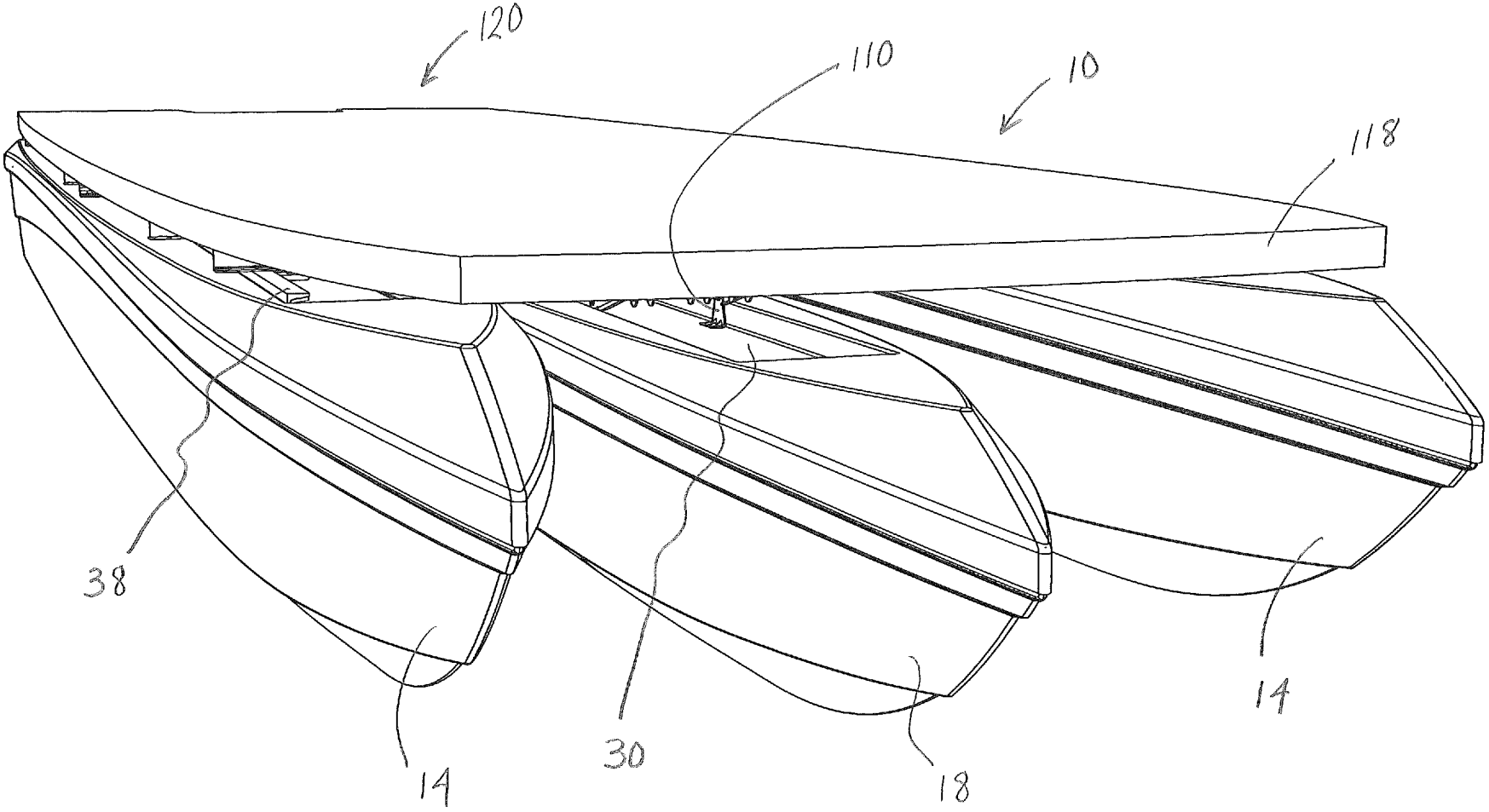
FIG. 8 is an isometric view of the boat shown in FIGS. 1-7 with the center pontoon in a position between its first and second positions with the lifting mechanisms partially extended.
Figure 9:
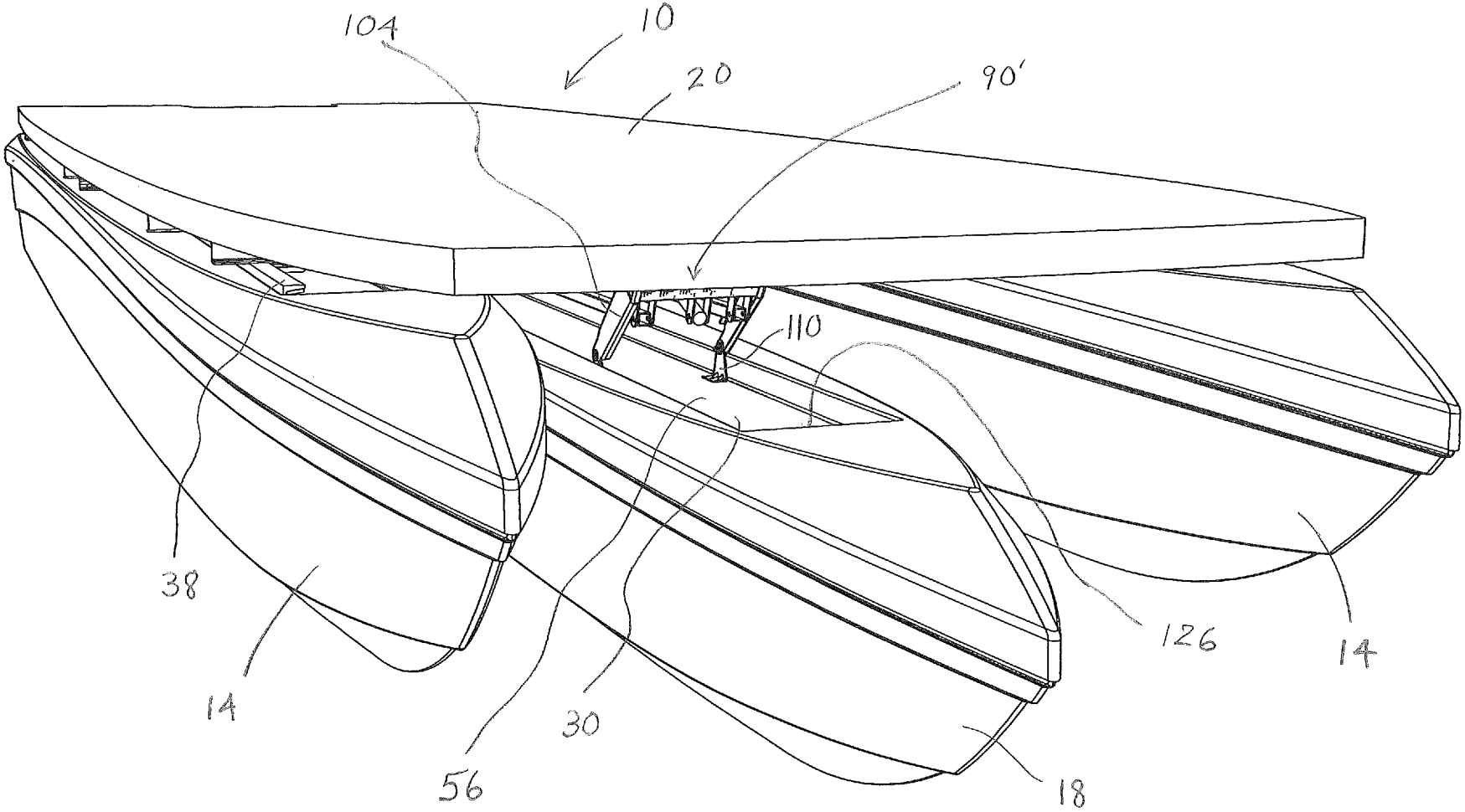
FIG. 9 is an isometric view of the boat shown in FIG. 1-8 with the center ponton in its second position and the lifting mechanisms in their fully extended positions.

The pontoon boat 10 of the present invention has two outer pontoons 14 and a central pontoon 18 that are connected to a deck 20. The outer pontoons 14 are fixed with respect to the deck 20. The central pontoon 18 is movable with respect to the deck 20 and the outer pontoons 14. The central pontoon 18 is movable between a first position that locates it relatively near the deck 20, which is a retracted position, and a second position that locates it relatively far from the deck 20, which is an extended position. FIGS. 1, 4, 6, 7 show the central pontoon 18 in its first position, and FIGS. 2, 5, 9 show the central pontoon 18 in its second position. The pontoons 14, 18 are molded shapes that provide not only displacement but also have their own individual shape that may help in planning and thus, the pontoons 14, 18 act as planning elements. Although each pontoon 14, 18 is shown to have a V-shaped hull, it is contemplated that cylindrical pontoons may be used. However, using circular pontoons may also include lifting strakes that assist in getting the pontoon boat 10 to plane faster. In the present embodiment of the invention, each pontoon 14, 18 has a lowermost edge 28 that is the lowest portion that is in the water. In the case of the boat 10 shown in FIGS. 1-9, each pontoon 14, 18 acts as a V-hull that will provide lifting force as the boat 10 moves faster through the water.

Figure 1:
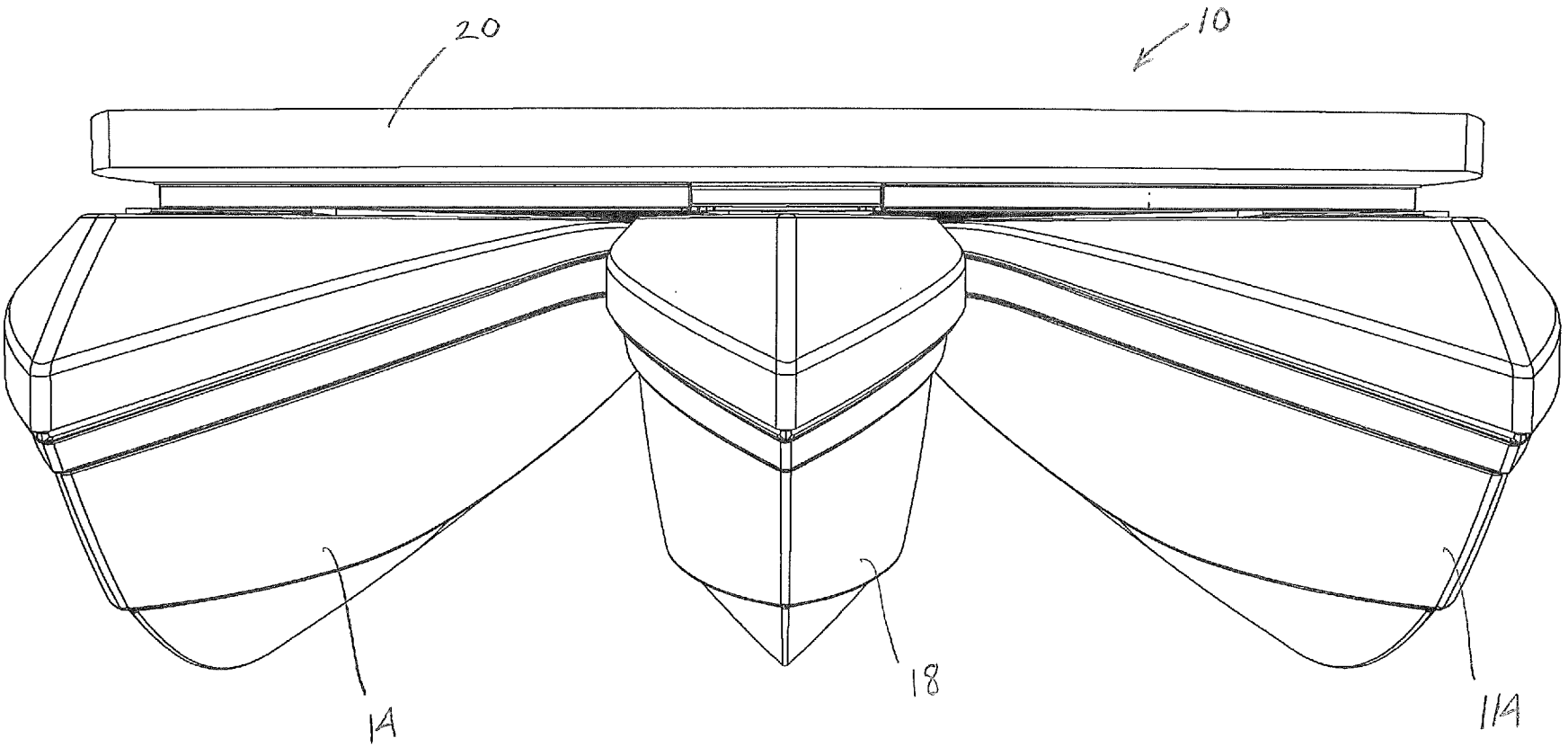
FIG. 1 is a view of the bow of a boat according to the present invention showing the central pontoon in its first position and the lifting mechanisms in their fully retracted positions.
Figure 2:
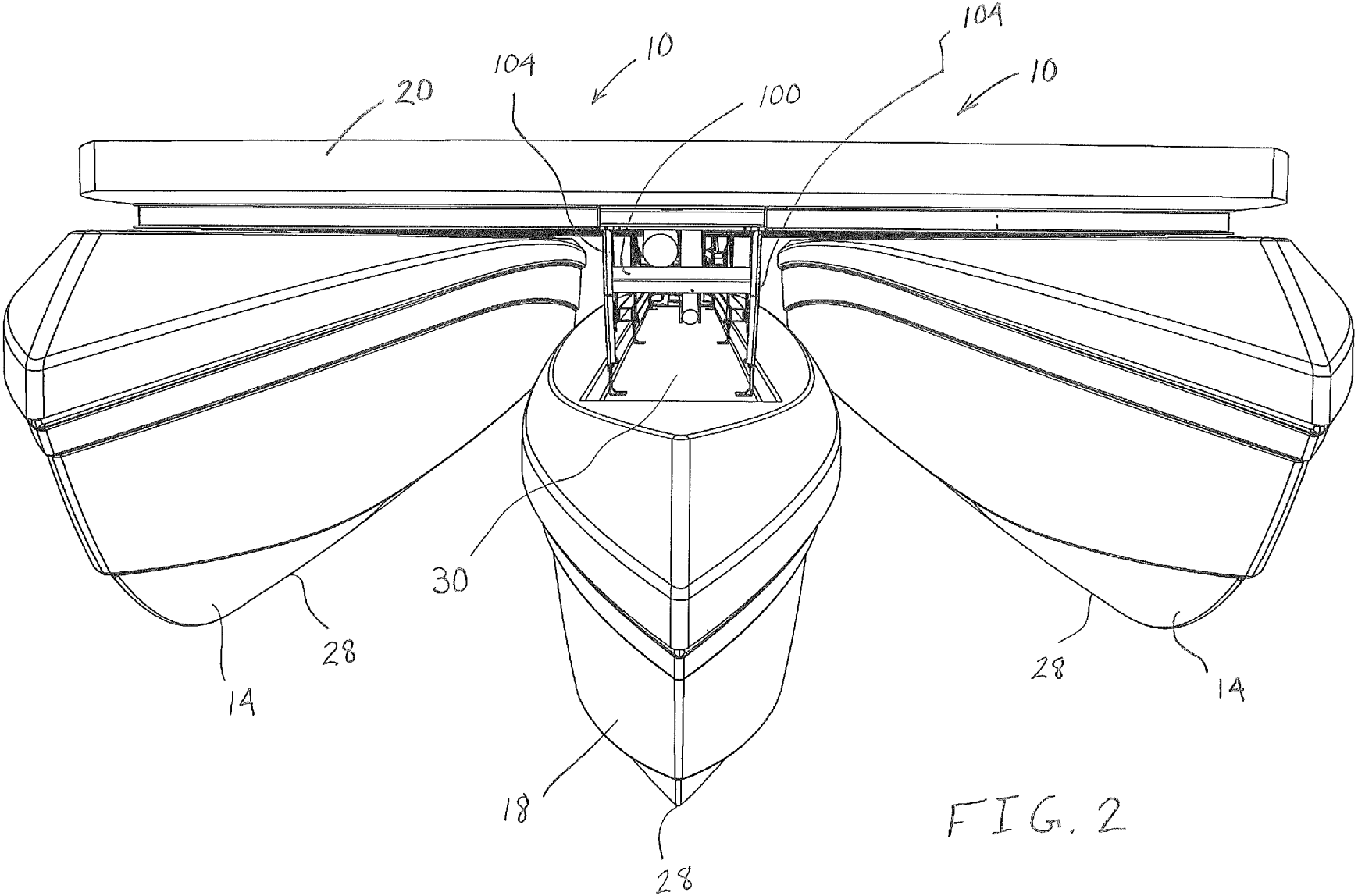
FIG. 2 is a view of the boat shown in FIG. 1 wherein the central pontoon is in its second position and the lifting mechanisms are in their fully extended positions.
Figure 12:
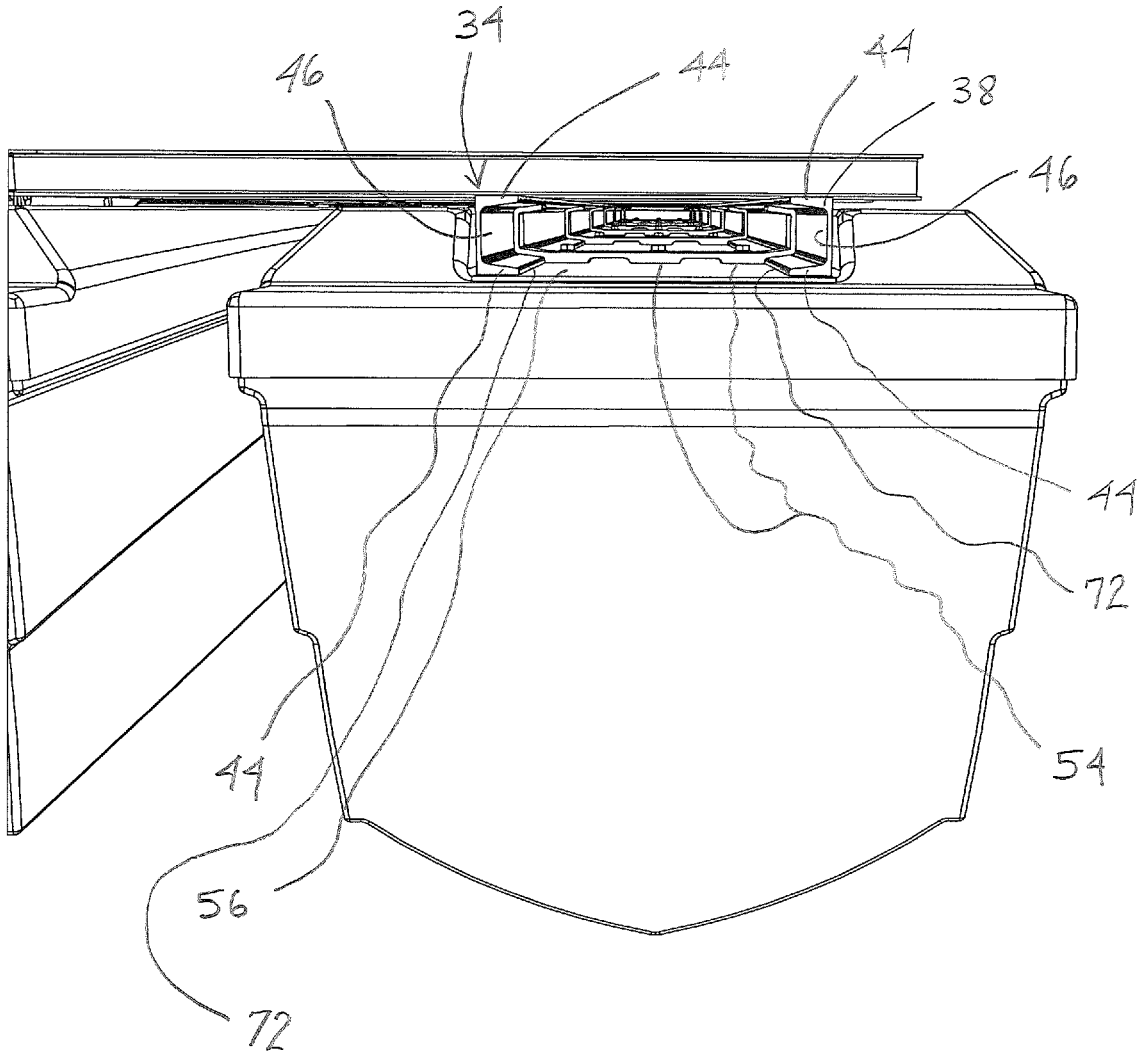
FIG. 12 an end view of the mounting system for the outer pontoons.
Figure 13:
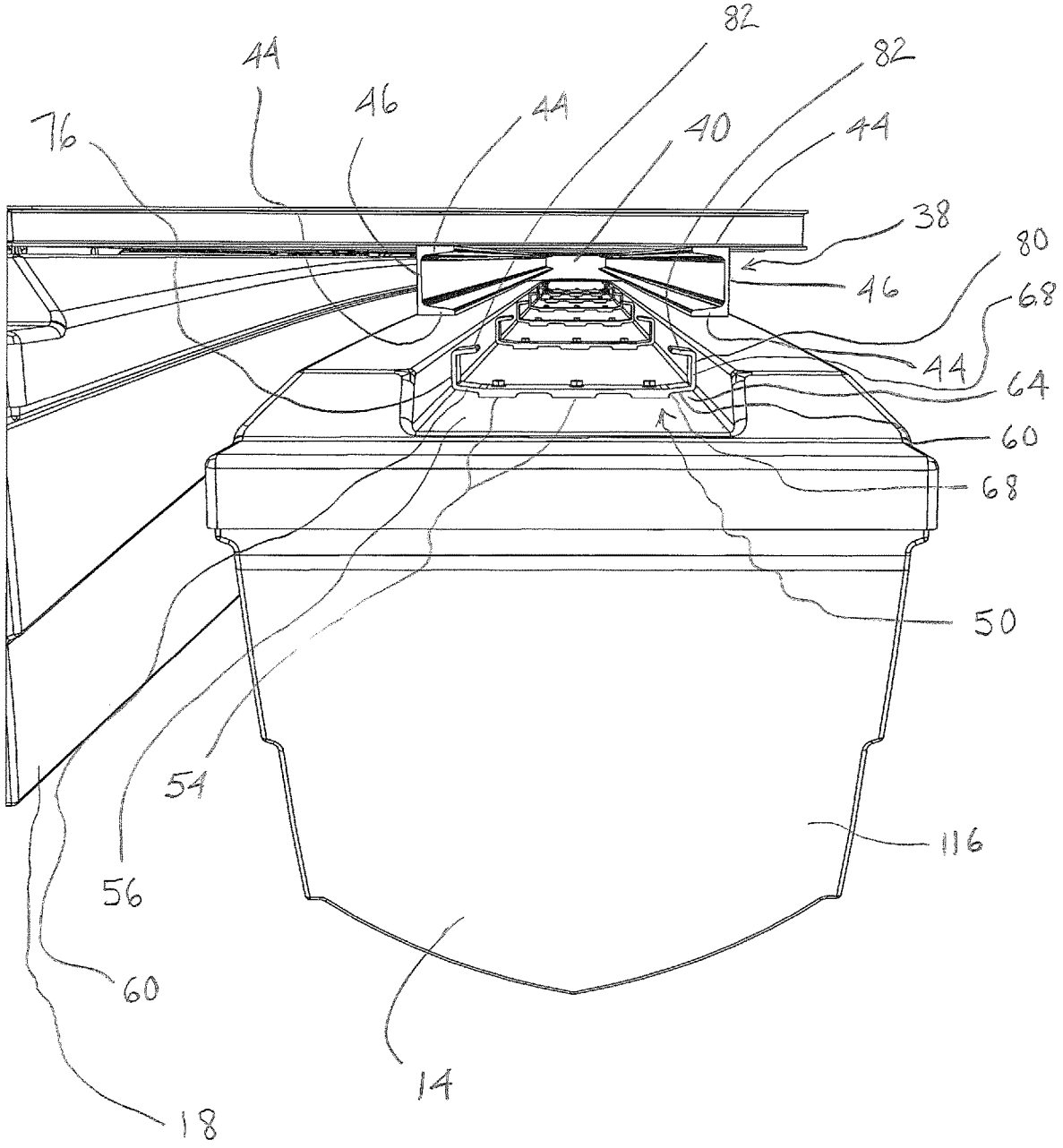
FIG. 13 is an exploded end view of the mounting system for the outer pontoons.

As shown in FIG. 1, each of the three pontoons 14, 18 are at the same respective distance with respect to the deck 20 when the central pontoon 18 is in its first position. The outer pontoons 14 may be mounted to the deck 20 in a manner as shown in FIGS. 12 and 13 that may include C-Channels, standoff blocks, or other rigid mounts that fix each of the outer pontoons 14 with respect to the deck 20.

Each pontoon 14, 18 includes a mounting slot 30 that accommodates mounting hardware 34 that may be made from readily available off the shelf parts. Longitudinal members 38 are mounted to the underside of the deck 20. As shown, the longitudinal members 38 are C-shaped, but other shapes are possible. The longitudinal members 38 have flanges 44 joined by a web 46 that spaces the flanges 44. The flanges 44 on adjacent longitudinal members 38 face each other so that the adjacent C-shapes face each other to form a channel 40. The longitudinal members 38 can be directly connected to the deck 12, and doing so will locate the pontoons 14 in nearer proximity to the deck 20. It is also contemplated that the flanges 44 on the longitudinal members face in opposite directions with respect to the web 46 to form a Z-section and this would yield a configuration that would place the flanges 44 on the top of the longitudinal members 38 on the outside of the channel 40 yet, still provide a suitable channel 40.

The channel 40 is made to receive a pontoon mounting bracket 50. The pontoon mounting bracket 50 has a pontoon mounting surface 54 that is directly mounted to the floor 56 of the mounting slot 30 in the pontoon 14, 18. The pontoon mounting bracket 50 has vertical restraining surfaces 60 that are spaced from the pontoon mounting surface 54 and on either side of the pontoon mounting surface 54. The vertical restraining surfaces 60 cooperate with the floor 56 to form gaps 64 that accommodate the flanges 44 of the longitudinal members 38 when the flanges 44 are inserted between the floor 56 of the mounting slot 30 and the installed mounting bracket 50. As can be seen in FIG. 12, the mounting surface 54 and the bottom of the flanges 44 are aligned when the vertical restraining surfaces 60 contact the flanges 44. In this manner, when the longitudinal members 38 are slid between the mounting bracket 50 and the pontoons 14, each pontoon 14 is restrained from vertical movement because the flanges 44 of the longitudinal members 38 are captured between the pontoon 14 and the pontoon mounting bracket 50. In other words, each gap 64 is the thickness of the flanges 44 received therein so no vertical movement is possible of the pontoon 14 with respect to the longitudinal members 38 and the deck 20. Each pontoon mounting bracket 50 has lower lateral guide surfaces 68 that engage inner edges 72 of the flanges 44 of each longitudinal member 38 that are opposite the deck 20. In addition to the lower lateral guide surfaces 68, the pontoon mounting brackets 50 have upper lateral guide surfaces 76 that engage the webs 46 of the opposing longitudinal members 38. Both the lower lateral guide surfaces 68 and the upper lateral guide surfaces 76 prevent lateral movement of the pontoon 14. In some cases, the upper lateral guide surfaces 76 can extend into lateral walls 80 which terminate in upper flanges 82. In such a pontoon mounting bracket 50, the entire bracket 50 forms a complementary shape to the channel 40 formed between the longitudinal members 38.

Installation of the outer pontoons 14 is accomplished by sliding each of the pontoons 14 onto the longitudinal members 38 that are affixed to the deck 20. The outer pontons 14 are first aligned with their stern ends 116 facing the longitudinal members 38. Each outer ponton 14 is then pushed backwardly toward the stern 120 of the boat 10. The outer pontoons 14 are moved toward the stern 120 of the boat 10 until the ends of the longitudinal members 38 nearest the bow 118 of the boat contact an end wall 126 of the mounting slot 30. The end wall 126 is located near the bow end 114 of each pontoon 14, 18. Once the end wall 126 of the pontoon 14 contacts the ends of the longitudinal members 38, a stop block 130 is affixed to the deck 20 near the stern 120 of the boat 10 and adjacent to the ends of the longitudinal members 38 nearest the stern 120 of the boat 10 to prevent forward sliding of the pontoons 14 from the boat. The stop blocks 130 are typically affixed to the deck 20 with removable fasteners. Removal of the pontoons 14, may be accomplished by removing the stop blocks 130 from deck 20, which will allow the pontoons 14 to be slid forwardly off of the deck 20. This simple removal of the pontoons 14 allows for easy servicing and replacement of the outer pontoons 14. The easy removal of the outer pontoons 14 also allows easy access to the center pontoon 18 so it may be serviced, or so that the lifting mechanisms 90 described below may be serviced.

Figure 10:
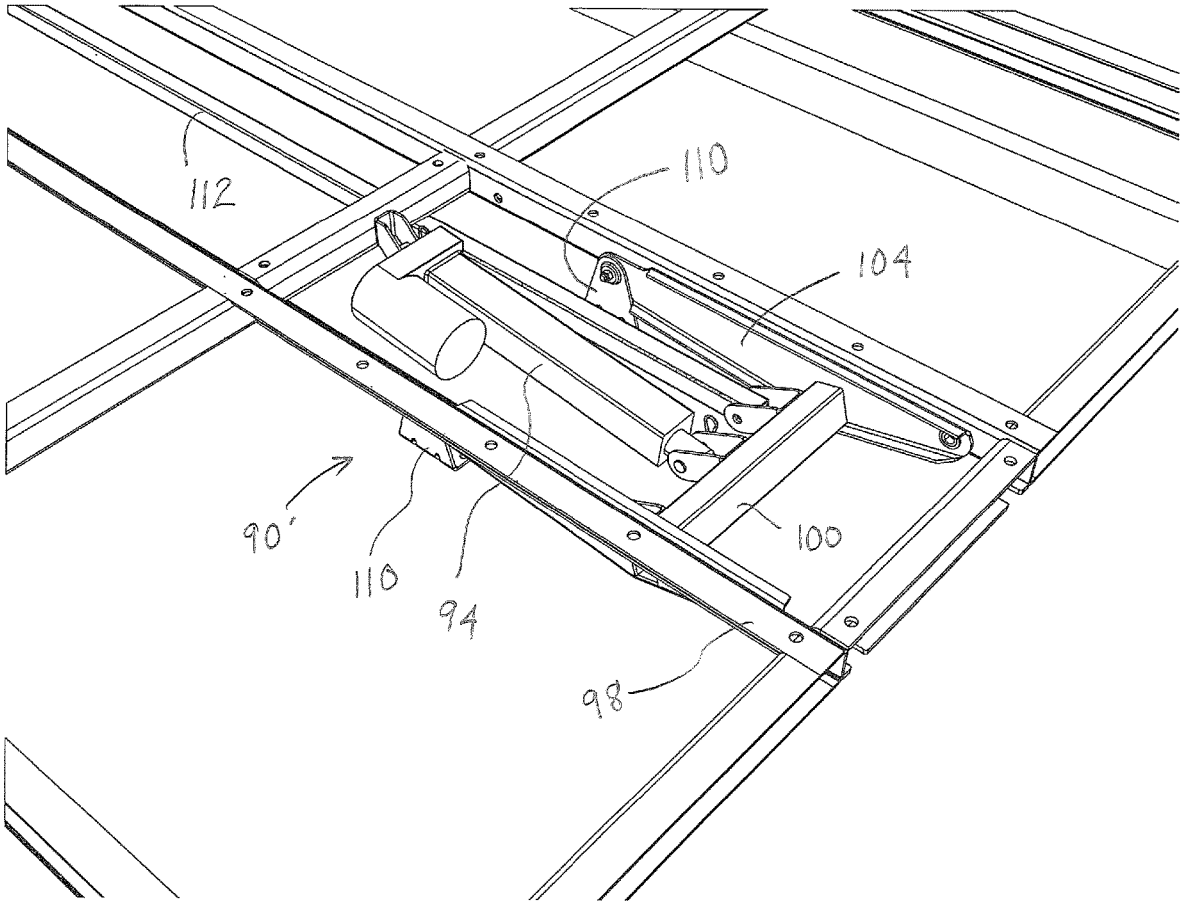
FIG. 10 is an isometric view of the lifting mechanism in its fully retracted position.
Figure 11:
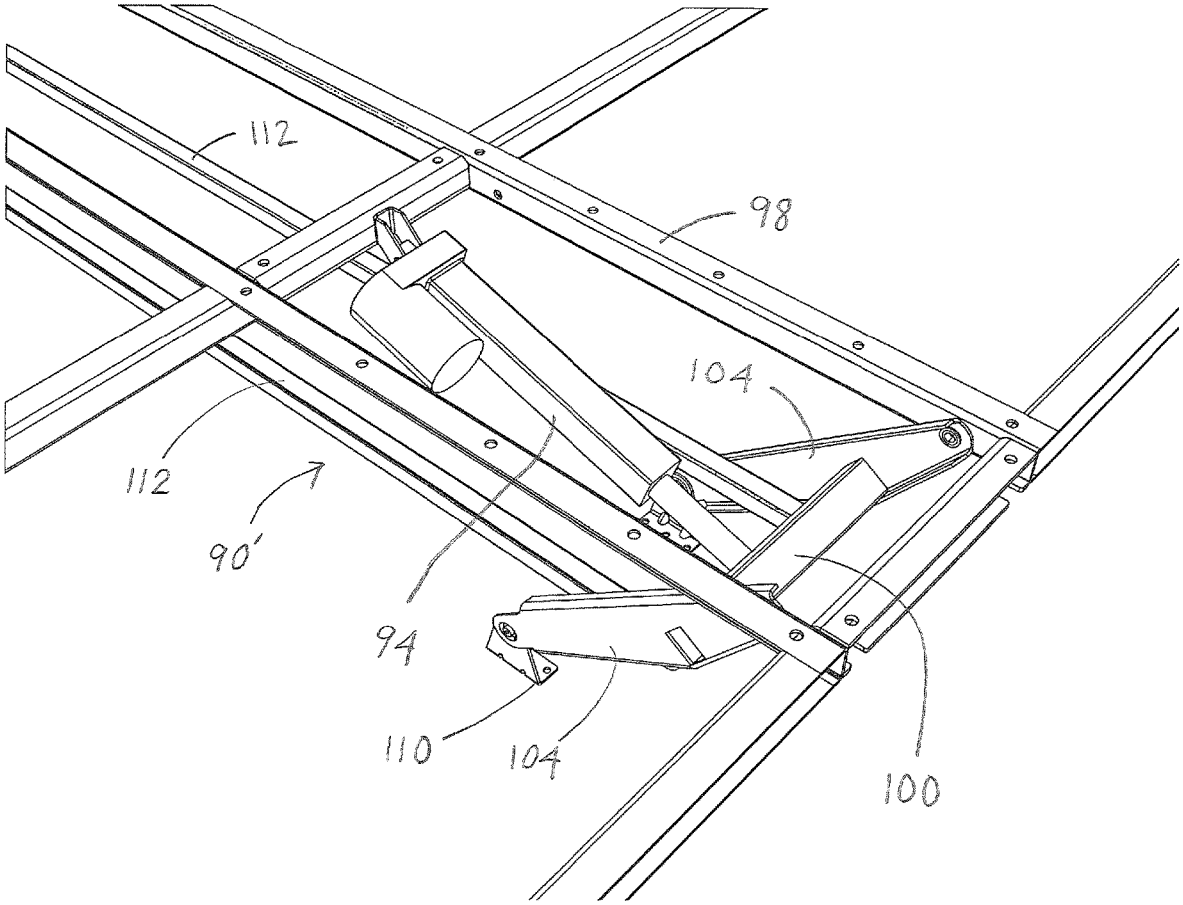
FIG. 11 is an isometric view of the lifting mechanism in its fully extended position.
Figure 14:
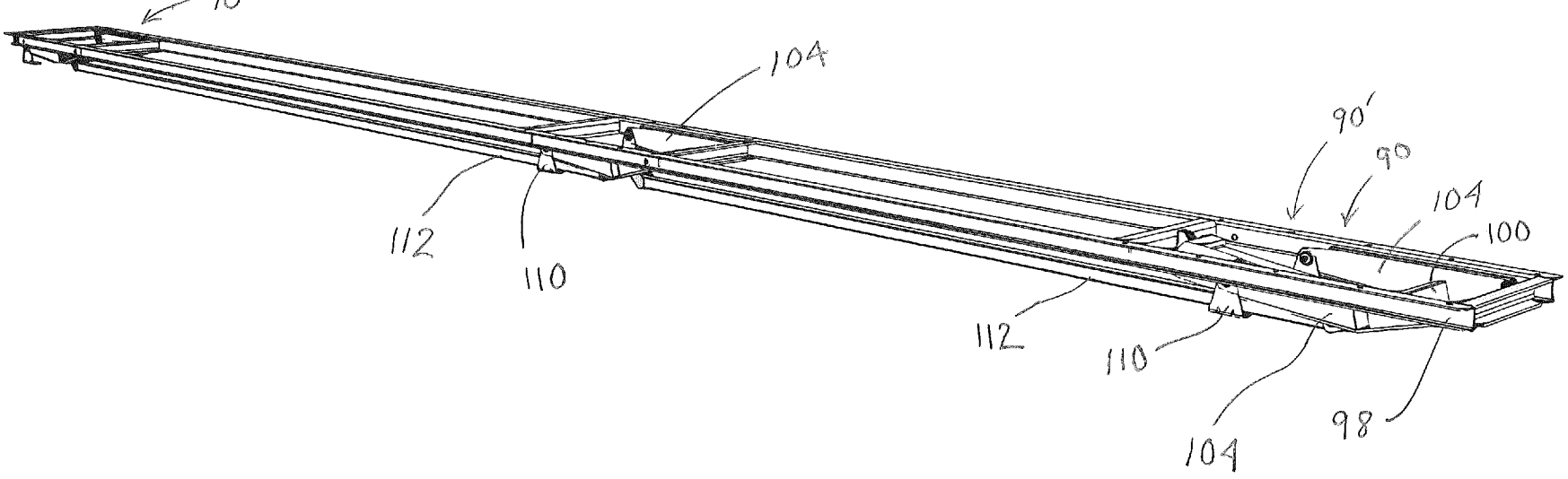
FIG. 14 is an isometric view of the lifting mechanisms alone in the retracted position.
Figure 15:
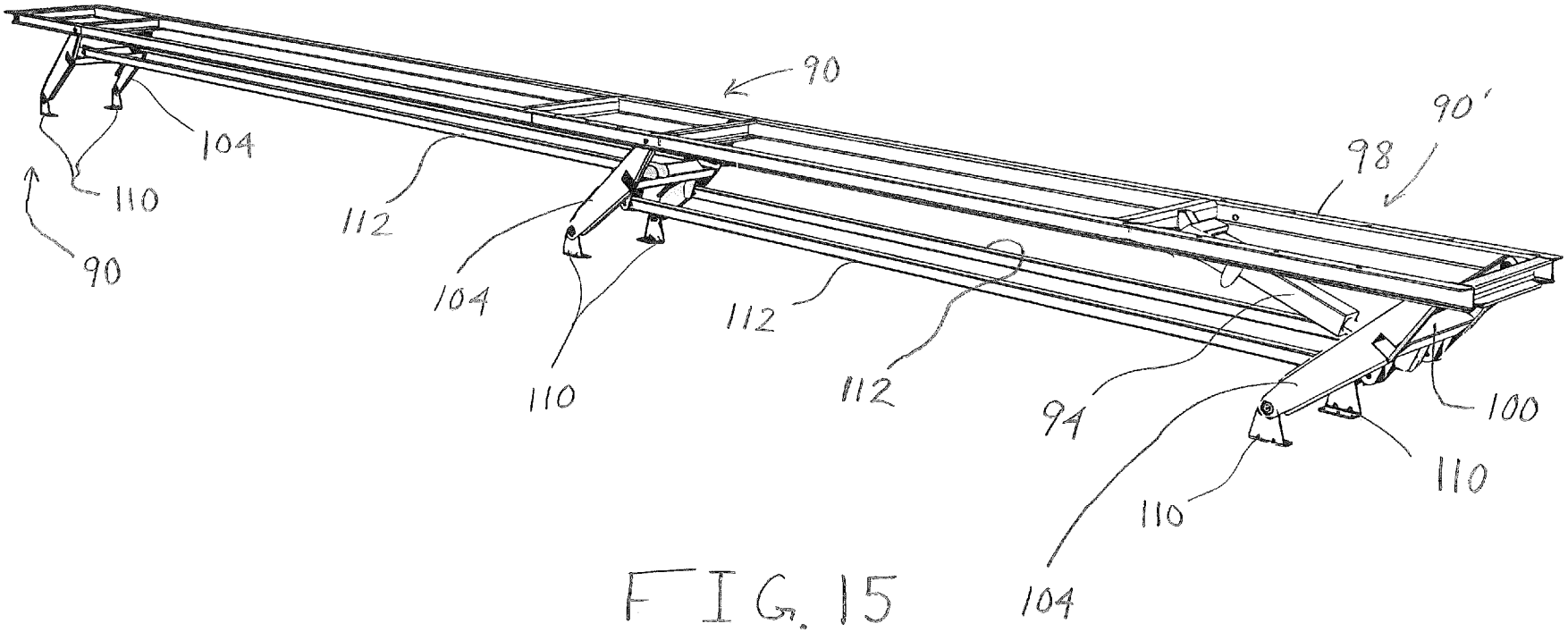
FIG. 15 is an isometric view of the lifting mechanisms shown in FIG. 14 in the extended position.

The center pontoon 18 is mounted to the deck 20 with multiple lifting mechanisms 90. The lifting mechanisms 90 may be actuated by hydraulic cylinders, screw machine, or other types of lifting devices that move the central pontoon 18 away from the deck 20 to its second position as shown in FIGS. 2, 5, and 9. FIG. 10 shows the lifting mechanism 90 in its retracted position and FIG. 11 shows the lifting mechanism 90 in its extended position. The lifting mechanism as shown in FIG. 10 includes an actuator 94 held within a frame 98. The actuator 94 is pivotally connected to the frame 98 and pivotally connected to a cross member 100 that is affixed to two pivot arms 104 that straddle the cross member 100. The actuator 94 is pivotally connected to the cross member 100 at a location offset from pivot points 106 on each arm 104, which corresponds to the locations that the arms 104 pivot about the frame 98. As such the arms 104 pivot with respect to the deck 20 and the actuator 94 is also pivotal with respect to the deck 20 and the arms 104. The offset of the actuator's 94 pivotal connection to the cross member 100 allows the actuator to generate a moment that produces torsional force about the pivot points 106 so that the actuator 94 can extend and retract the arms 104. The ends of the arms 104 opposite pivot points 106 are pivotally connected to mounting brackets 110 that are connected to the floor 56 of the mounting slot 30 of pontoon 18. The lifting mechanisms 90 can be configured as shown in FIGS. 14 and 15 which show the forwardmost lifting mechanism 90' is powered by the actuator 94 and the remaining lifting mechanisms 90 are pivotally connected by linkages 112 that move the arms 104 of the successive lifting mechanisms 90 that are rearward of the forwardmost lifting mechanism 90'. The successive lifting mechanisms 90 act as slave lifting mechanisms 90 because as shown in FIG. 15, the forwardmost lifting mechanism 90' imparts the lifting forces to all of the slave lifting mechanisms 90 behind the forwardmost lifting mechanism 90 having the actuator 94. As the actuator 94 moves from its fully retracted position as shown in FIG. 10 to the fully extended position in FIG. 11, it moves the center pontoon 18 from its first retraced position to its second extended position. Throughout the movement from the retracted position to the extended position, the center pontoon 18 moves in a parallel motion because the linkages 112 facilitate synchronous movement of all the arms 104 of each lifting mechanism 90 at the same rate. Although it is not shown, it is contemplated that each liftin mechanism 90 may have its own actuator 94 in lieu of employing the linkages 112 described above.

Each pontoon 14, 18 has a bow end 114 and a stern end 116. The bow end 114 is nearer the bow 118 of the boat 10 and the stern end 120 is nearest the stern 50 of the boat 10. During this movement the bow end 114 and stern end 116 of the central pontoon 18 are equally spaced from the deck 20 so that the central pontoon 18 remains substantially parallel to the deck 20 and parallel to the outer pontoons 14. Movement in this manner ensures that the central pontoon 18 does not alter its pitch with respect to the boat 10 and therefore, the central pontoon 18 retains the same pitch to the water as the outer pontoons 14. In other words, the angle of the central pontoon 18 remains the same with respect to the deck 20 as the central ponton 18 moves from its first to second positions. Thus, the orientation of the central pontoon 18 with respect to the deck 20 in its first position is the same orientation in the second position and at all locations between the first and second positions.

An important feature of the lifting mechanisms 90 is that they are selectively lockable at all positions between the first and second position of the central pontoon 18 corresponding to the retracted and extended position of the lifting mechanism 90 respectively. It should also be noted that the lifting mechanisms 90 are selectively lockable at their fully retracted and fully extended positions, which correspond to the first and second positions of the central pontoon 18 respectively as described above. This means that the depth the central pontoon 18 extends into the water may be changed with respect to the outer pontoons 14. The lockable nature of the lifting mechanisms 90 may be done through an actuator 94 that is a screw drive mechanism that cannot be back driven, or the actuator 94 can achieve its lockability through hydraulics that are effectively locked with valves.

Figure 3:
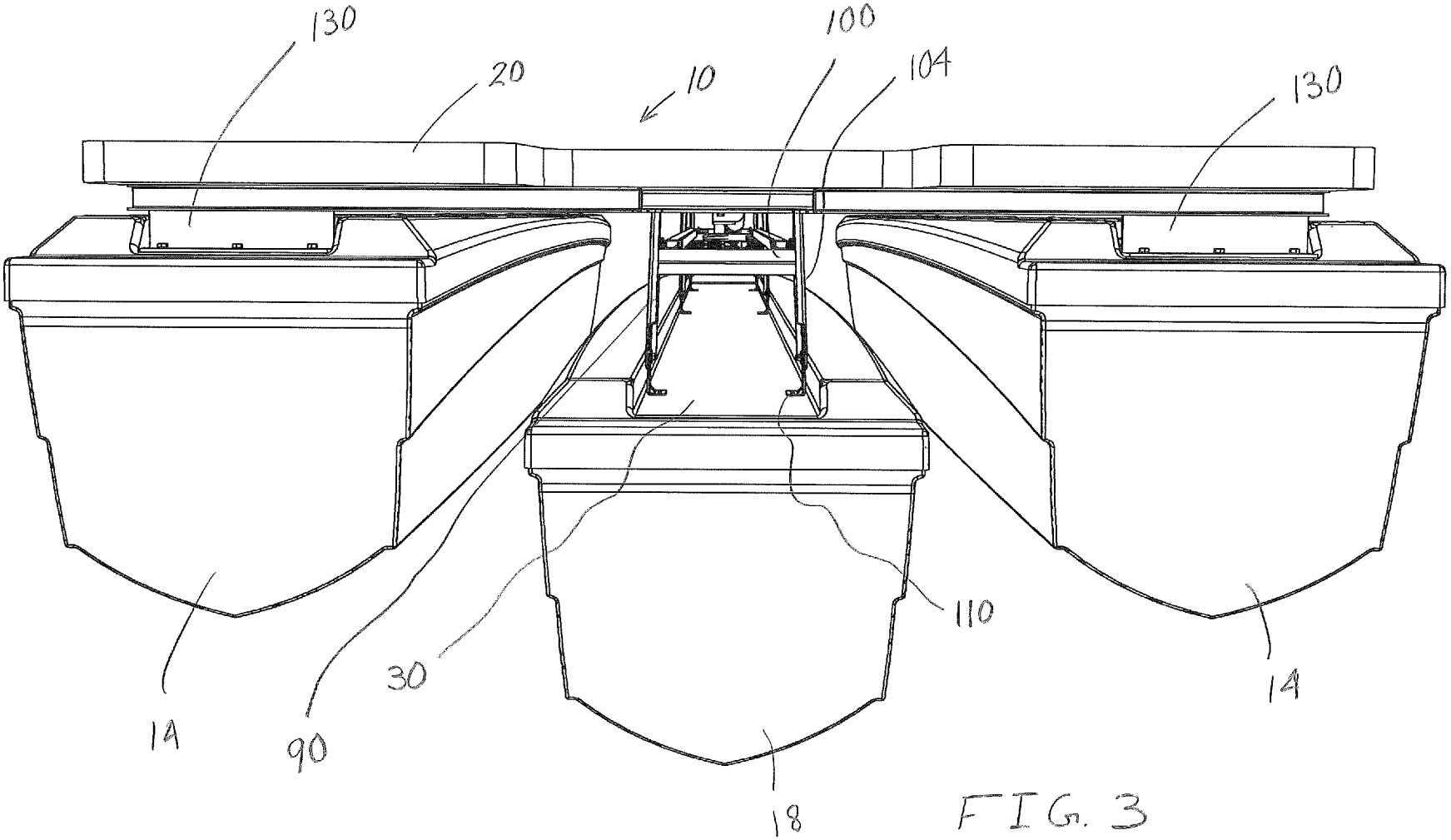
FIG. 3 is a view of the stern of the boat show in FIGS. 1 and 2 wherein the central ponton is in its second position.
Figure 4:
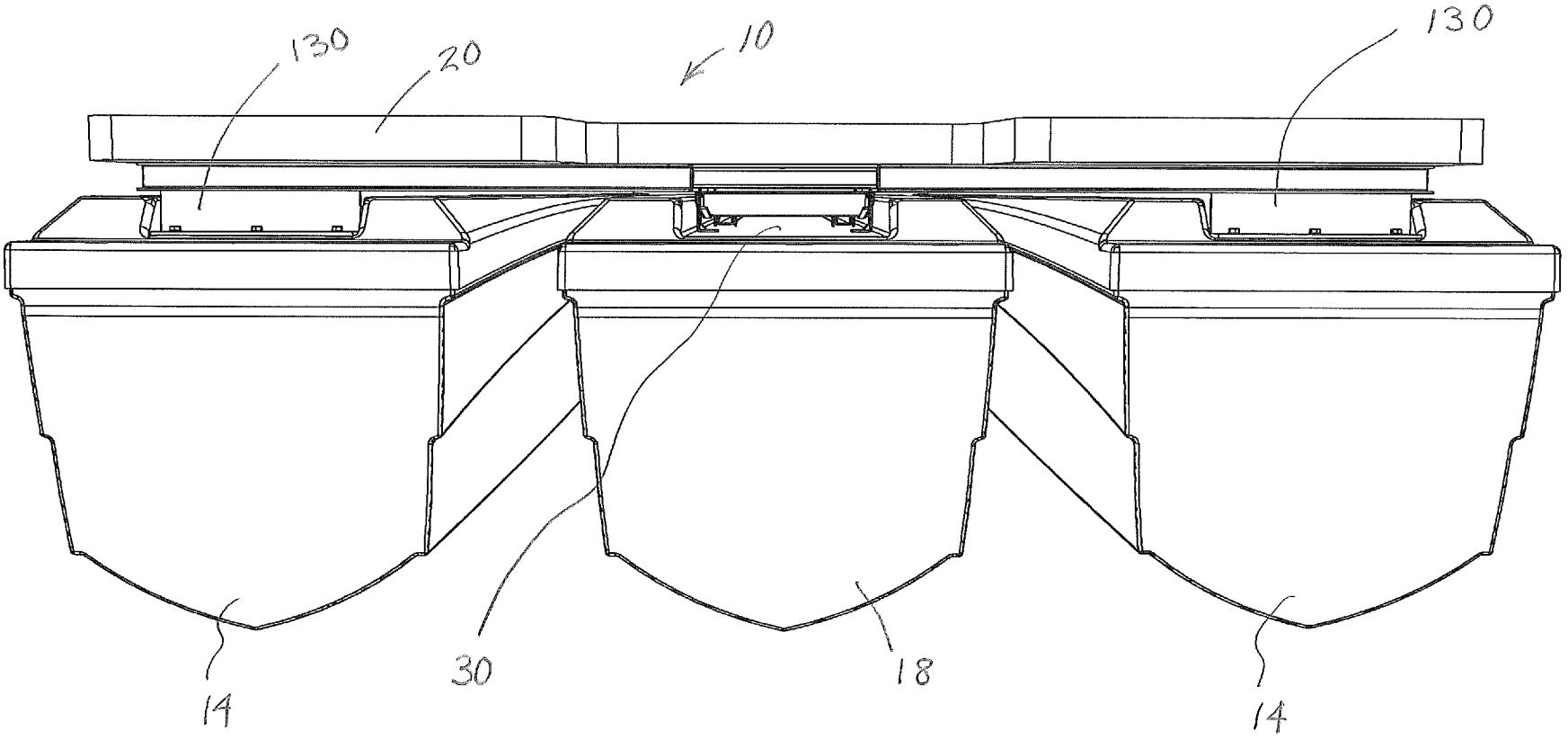
FIG. 4 is a view of the stern of the boat shown in FIGS. 1-3 with the central pontoon in its first position.

The boat 10 may have its hull configured as somewhat similar to a V-Hull when the central pontoon 18 is in its second position and the lifting mechanisms 90 are fully extended. The boat 10 may also have the attributes of a traditional pontoon boat when the central pontoon 18 is in its first position and the lifting mechanism 90 is fully retracted. The ability to adapt by moving the central pontoon 18 between the first and second positions provides a boat 10 that can handle many operating situations with optimal performance. Moving the central pontoon 18 into the second position approximates a V-hull type of boat. In a typical V-hull boat, such a watercraft tends to lean inward into turns and this enhances stability. When a user of the boat 10 of the present invention intends to use the boat 10 at high speeds, he may use the lifting mechanisms 90 to locate the central pontoon 18 in its second position. When the lifting mechanism 38 is in its fully extended position, the central pontoon 18 can be eight inches below the outer pontoons 14. As such, the three pontoons 14, 18 will resemble a V in cross section as shown in FIGS. 2, 3, and 9. When the boat is used at slower speeds, the central pontoon 18 may be moved to its first position so that the pontoons 14, 18 provide a stable platform for the deck 20. In addition to manually moving the central pontoon 18, the boat 10 may be equipped with a system that senses water speed. In response to the water speed, the control system may lower the central pontoon toward its second position and continually adjust the position of the central pontoon 18 to correspond with the best handling for the water speed.

The invention is not limited to the details provided above, but may be modified within the scope of the following claims.

What is claimed is:

1. A pontoon boat comprising:

a central ponton and outer pontoons;

a deck, said central pontoon and outer pontoons supporting said deck, said outer pontoons being fixed with respect to said deck and said central pontoon movable with respect to said outer pontoons and said deck between a first position locating said central pontoon near said deck and a second position locating said central pontoon relatively far from said deck;

a lifting mechanism fixed with respect to said deck and said lifting mechanism including an arm pivotally connected between said deck and said central pontoon, an actuator pivotally connected to said arm for pivoting said arm with respect to said deck to move said central pontoon between said first and second positions, said central pontoon being selectively lockable between said first and second positions.

2. The pontoon boat of claim 1, wherein said central pontoon has a pitch with respect to said deck in said first position, said pitch remaining constant throughout movement of said central pontoon from said first position to said second position.

3. The pontoon boat of claim 1, further comprising a second lifting mechanism being connected to said lifting mechanism, said second lifting mechanism including an arm being linked to said arm of said lifting mechanism with a linkage and movement of said lifting mechanism moves said arm of said second lifting mechanism.

4. A pontoon boat comprising:

outer pontoons and a central pontoon located between said outer pontoons;

a deck, said central pontoon and said outer pontoons supporting said deck, said outer pontoons being fixed with respect to said deck and said central pontoon movable with respect to said outer pontoons and said deck between a first position locating said central pontoon near said deck and a second position locating said central pontoon relatively far from said deck, said central pontoon being selectively fixable between said first and second positions;

wherein elongate members are affixed to said deck and said elongate members include a flange spaced from said deck, one of said outer pontoons including a pontoon mounting bracket having a pontoon mounting surface for being in fixed contact to said one outer pontoon and a vertical restraining surface spaced from said pontoon mounting surface and spaced from said pontoon when said pontoon mounting surface is in contact with said one outer pontoon, said flange of said elongate member being restrained from vertical movement when said flange is located between said one outer pontoon and said vertical restraining surface.

5. The pontoon boat of claim 4, wherein said central pontoon has a pitch with respect to said deck in said first position, said pitch remaining constant throughout movement of said central pontoon from said first position to said second position.

6. The pontoon boat of claim 5, wherein said central pontoon is fixable between said first and second positions.

7. The pontoon boat of claim 6, wherein said central pontoon moves between said first and second position being substantially parallel throughout said movement between said first and second positions.

8. The pontoon boat of claim 4, wherein said flanges of said elongate members include inner edges facing each other, said ponton mounting bracket including lower lateral guide surfaces, said lower lateral guide surfaces for being located adjacent to said inner edges of said flanges to restrain lateral movement of said one pontoon when said flanges are located between said vertical restraining surface and said one pontoon.

9. The pontoon boat of claim 8, wherein said elongate members include a web connected to said flange and said pontoon mounting bracket includes upper lateral guide surfaces for being located adjacent to said webs of said elongate members when said pontoon mounting bracket is located between said elongate members, said upper lateral guide surfaces restraining lateral movement of said one pontoon when said flanges are located between said vertical restraining surface and said one pontoon.

10. A pontoon boat comprising:

outer pontoons and a central pontoon located between said outer pontoons;

a deck, said outer pontoons fixed to said deck and said central pontoon movably affixed to said deck and said central pontoon being movable with respect to said outer pontoons, said central pontoon being movable between a first position locating said central pontoon near said deck and a second position locating said central pontoon relatively far from said deck, said central pontoon being selectively lockable between said first and second positions;

a lifting mechanism fixed with respect to said deck and said lifting mechanism including an arm pivotally connected between said deck and said central pontoon, an actuator pivotally connected to said arm for pivoting said arm with respect to said deck to move said central pontoon between said first and second positions.

11. The pontoon boat of claim 10, further comprising a second lifting mechanism being connected to said lifting mechanism, said second lifting mechanism including an arm being linked to said arm of said lifting mechanism with a linkage and movement of said lifting mechanism moves said arm of said second lifting mechanism.

12. The pontoon boat of claim 10, wherein elongate members are affixed to said deck and said elongate members include a flange spaced from said deck, one of said outer pontoons including a pontoon mounting bracket having a pontoon mounting surface for being in fixed contact to said one outer pontoon and a vertical restraining surface spaced from said pontoon mounting surface and spaced from said pontoon when said pontoon mounting surface is in contact with said one outer pontoon, said flange of said elongate member being restrained from vertical movement when said flange is located between said one outer pontoon and said vertical restraining surface.

13. The pontoon boat of claim 12, wherein said flanges of said elongate members include inner edges facing each other, said ponton mounting bracket including lower lateral guide surfaces, said lower lateral guide surfaces for being located adjacent to said inner edges of said flanges to restrain lateral movement of said one pontoon when said flanges are located between said vertical restraining surface and said one pontoon.

14. The pontoon boat of claim 13, wherein said elongate members include a web connected to said flange and said pontoon mounting bracket includes upper lateral guide surfaces for being located adjacent to said webs of said elongate members when said pontoon mounting bracket is located between said elongate members, said upper lateral guide surfaces restraining lateral movement of said one pontoon when said flanges are located between said vertical restraining surface and said one pontoon.

* * * * *